US009663334B2

(12) United States Patent
Higgins

(10) Patent No.: US 9,663,334 B2
(45) Date of Patent: May 30, 2017

(54) SLIDING LOCK MECHANISM FOR SECURING A JIB ASSEMBLY

(71) Applicant: Altec Industries, Inc., Birmingham, AL (US)

(72) Inventor: Daniel J. Higgins, Raleigh, NC (US)

(73) Assignee: Altec Industries, Inc., Birmingham, AL (US)

( * ) Notice: Subject to any disclaimer, the term of this patent is extended or adjusted under 35 U.S.C. 154(b) by 341 days.

(21) Appl. No.: 14/471,912

(22) Filed: Aug. 28, 2014

(65) Prior Publication Data

US 2016/0060081 A1 Mar. 3, 2016

(51) Int. Cl.
*B66C 23/66* (2006.01)

(52) U.S. Cl.
CPC ..... *B66C 23/66* (2013.01)

(58) Field of Classification Search
CPC ..... B66C 23/66; B66C 23/64; B66C 23/62; B66C 23/708; B66C 23/04; B66C 23/701; B66C 23/702; B66C 23/705
USPC ..... 37/468, 403; 70/208
See application file for complete search history.

(56) References Cited

U.S. PATENT DOCUMENTS 4,582,206 A * 4/1986 Johnson ..... B66F 11/046 182/2.9

* cited by examiner

*Primary Examiner* — Emmanuel M Marcelo
*Assistant Examiner* — Juan Campos, Jr.
(74) *Attorney, Agent, or Firm* — Erise IP, P.A.

(57) ABSTRACT

A jib assembly has a sheath, a jib arm disposed within the sheath, and at least two gripping components disposed on the inner surface of the sheath. The sheath is operable to engage the jib arm to secure the jib arm and prevent the jib arm from extending and retracting relative to the sheath by aligning the sheath to be substantially parallel with the jib arm. The sheath is operable to disengage the jib arm to allow at least a portion of the jib arm to extend and retract relative to the sheath by rotating the sheath away from substantially parallel with the jib arm.

18 Claims, 9 Drawing Sheets

SLIDING LOCK MECHANISM FOR SECURING A JIB ASSEMBLY

BACKGROUND

1. Field

Embodiments of the invention relate to a jib assembly that is the projecting arm of a crane or the like. More particularly, embodiments of the invention relate to a sliding lock mechanism for securing the jib assembly in a desired position.

2. Related Art

A jib assembly broadly comprises a jib arm extending from a support base. The jib assembly bears a load or an item of equipment. The jib arm may be telescoping to extend or retract into itself or into the base. The jib arm may rotate around the base in either or both of vertical and horizontal positions. The base itself may be movable relative to a larger item of equipment, such as a crane or a boom of an aerial device. In some embodiments, the jib assembly may be mounted at a distal end of the crane or the boom. The combination of these movements allows the jib arm to move the load or item of equipment into a desired location or orientation.

Jib assemblies are frequently mounted on construction equipment, such as the above-mentioned cranes, excavators, digger derricks, and utility trucks. Jib assemblies are also commonly used for video cameras, because they facilitate shots not possible to a person holding a video camera, such as sweeping shots and high angle shots. Jib assemblies may also be employed for moving equipment into and out of a truck bed.

In more detail, jib assemblies generally comprise a base, an outer boom coupled to the base, and a jib arm at least partially telescopically received within the outer boom. The jib arm is extended by moving a section of the jib arm external to the outer boom. Other jib assembly embodiments may comprise a base and a jib arm. In such a jib assembly, the jib arm extends and retracts relative to the base.

Power sources to extend and retract the jib assemblies include hydraulics, pneumatics, electric power, and manual force. Once in a desired position, the jib assemblies typically use at least one pin to secure the jib arm in place. The pins are emplaced into an opening in both the jib arm and the outer boom. The pins prevent the jib arm from extending or retracting once set. When the operator desires to alter the jib arm's position, he removes the pins, moves the jib arm in or out to the desired position, and reinserts the pins.

There are several drawbacks to this configuration. First, the pins can be difficult to reach, as they are typically on only one side of the jib assembly. Second, the pins can be difficult to insert into and remove from the openings in the jib arm because of binding. Third, this configuration requires precise alignment of the interior and outer booms of the jib assembly. Fourth, the operator is limited in what position he can extend or retract the jib arm, because it must align with the limited number of holes in the jib arm. Fifth, the pins can wear out and break under the pressures resulting from the load on the jib assembly. Finally, an operator can forget to re-engage the pins, resulting in an unsafe operating environment.

SUMMARY

Embodiments of the invention solve the above-mentioned problems by providing a sliding lock mechanism for securing the jib assembly in lieu of pins. The sliding lock mechanism provides quick and easy unlocking of the jib assembly, shifting of a jib arm associated with the jib assembly to any of numerous desired locations, and quickly and easily locking the jib arm in a desired location.

The jib assembly of embodiments of the invention provides several advantages over prior art locking mechanism. First the sliding lock mechanism can be operated from any side that the operator can reach. Second, the sliding lock mechanism does not require the fine operator movements of locating and removing pins. It is also resistant to the binding that commonly occurs with locking pins. Third, the sliding lock mechanism does not require precise alignment before re-engaging the lock. Fourth, the sliding lock mechanism can be engaged at virtually any point along the jib arm, allowing the operator to set a more precise length. Fifth, the load is distributed over a much wider area, reducing the wear and tear on the jib assembly. Finally, the sliding lock mechanism is always locked when not being opened by the operator.

A jib assembly in accordance with one embodiment comprises a base, an outer boom, a jib arm, and a sliding lock mechanism. The sliding lock mechanism in accordance with one embodiment of the invention comprises a sheath, having a plurality of gripping components, that covers the jib arm of the jib assembly. The sheath is connected to the outer boom or to the base of the jib assembly. In other embodiments, the sheath is not connected to any structure and instead only surrounds the jib arm.

The sheath is movable between first and second positions. When in the first position, the plurality of gripping components mechanically locks and secures a ribbed surface of the jib arm. When in the second position, the jib arm can slide with little resistance, as the gripping components are not in contact with the ribbed surface of the jib arm. In embodiments, the sheath is in the first position when the sheath is substantially parallel with the jib arm. The sheath is in the second position when the sheath is tilted from the substantially parallel alignment with the jib arm, which may occur upon operator movement or by a mechanical actuation of the jib arm.

In another embodiment of the invention, one or more collars can be utilized around the jib arm. These collars can perform multiple functions, such as, but not limited to, providing a secondary stop to prevent the jib arm from retracting into the sheath beyond the location of the collar, ensuring smooth movement through the sheath when the sheath is in the second position, and providing a secondary safety that must be released before the jib arm can extend or retract.

Also optionally, one or more biasing elements may be used to hold the jib arm on to the gripping components. This will help ensure that the stability of the sliding lock mechanism when there is no load on the jib assembly.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWINGS

Embodiments of the invention are described in detail below with reference to the attached drawing figures, wherein.

Figure 1:
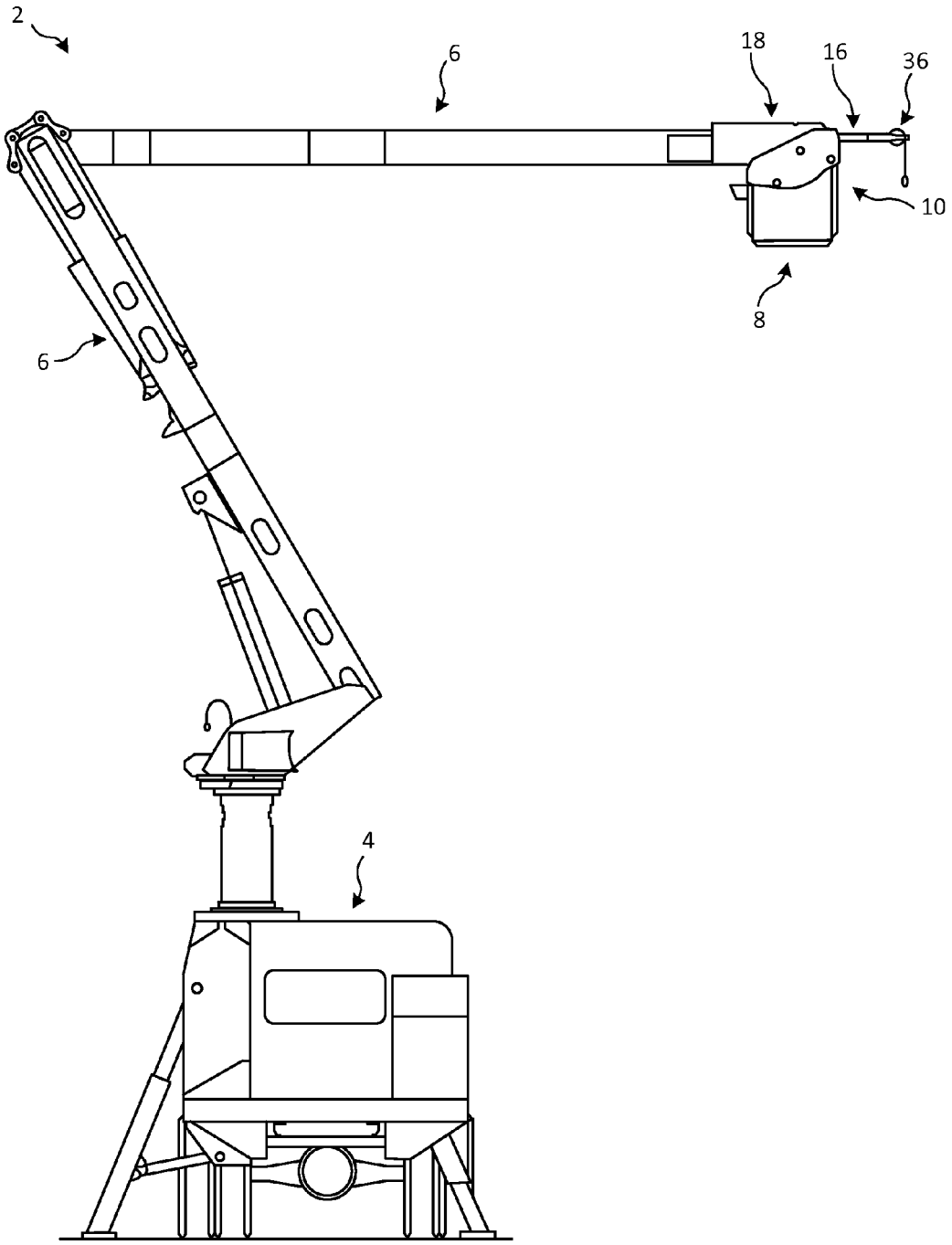
FIG. 1 is an environmental view of an exemplary jib assembly mounted on a boom of an aerial device.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention may be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etcetera described in one embodiment may also be included in other embodiments, but is not necessarily included. Thus, the present technology can include a variety of combinations and/or integrations of the embodiments described herein.

Figure 10:
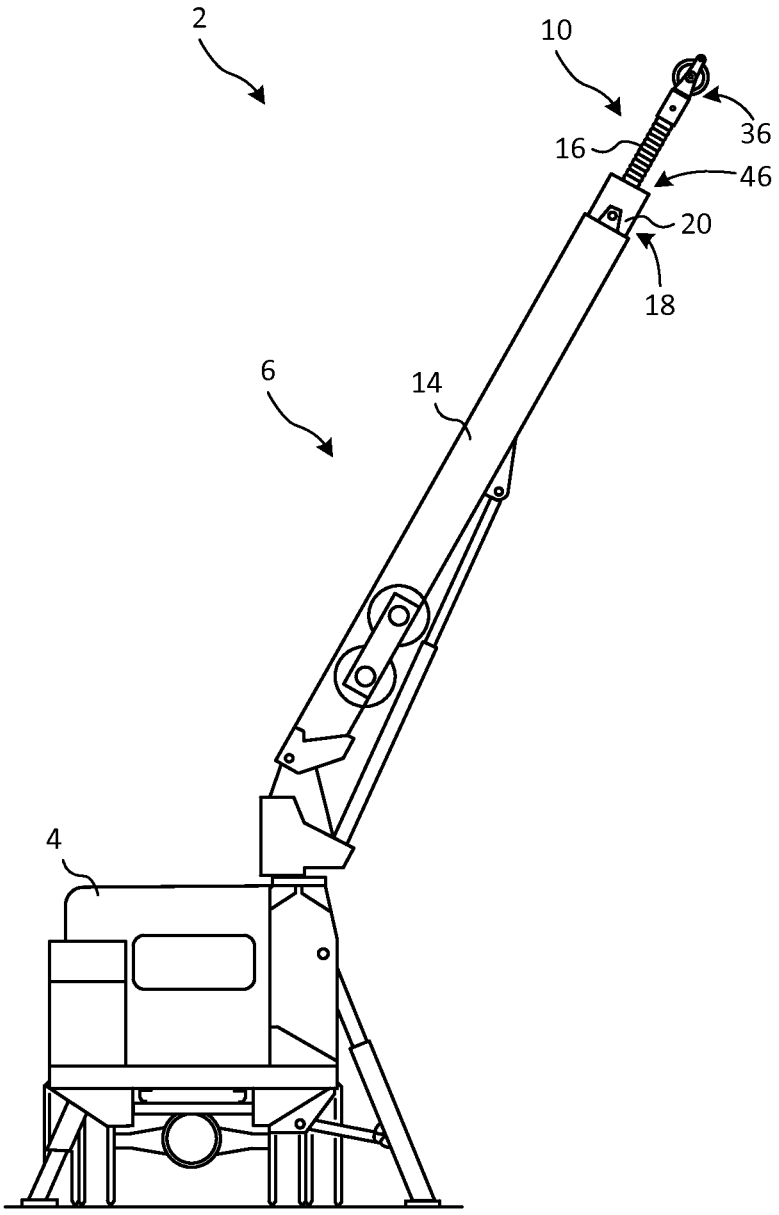
FIG. 10 is an environmental view of yet another exemplary embodiment of the invention, in which the jib is coupled within an outer boom section.
Figure 11:
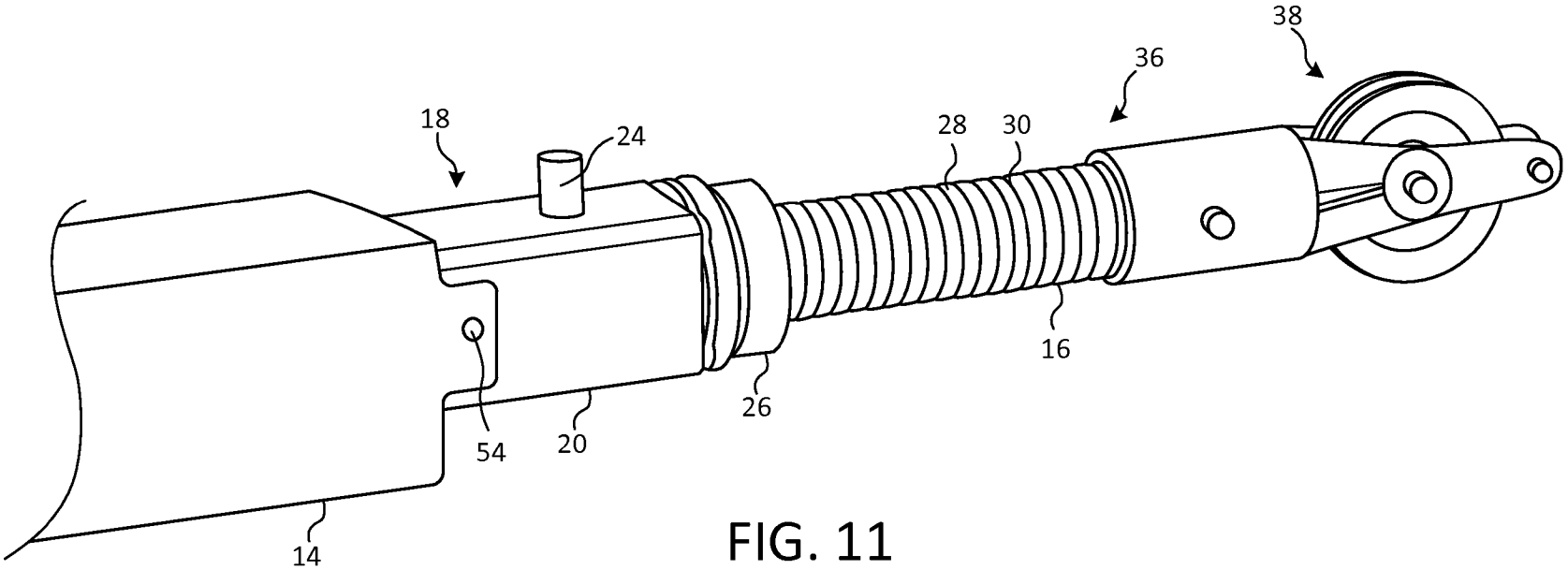
FIG. 11 is a fragmentary perspective view of the exemplary embodiment of the invention from FIG. 10.

Turning now to the drawings, and specifically FIG. 1, an aerial device 2 comprises a base 4, a boom assembly 6, a utility platform 8, and a jib assembly 10. In embodiments of the invention, the jib assembly 10 is mounted to a jib mounting assembly 12 or an outer boom 14 (as illustrated in FIGS. 10 and 11). The jib assembly 10 comprises a jib arm 16 and a sliding lock mechanism 18. In embodiments, the boom assembly 6 is pivotably and/or rotationally coupled to the base 4. The jib arm 16 is at least partially disposed within the jib mounting assembly 12 which is secured to the utility platform 8, such that the jib arm 16 can telescope to extend and retract. The sliding lock mechanism 18 provides an interface to selectively secure the jib arm 16 in a given position.

In other embodiments, the jib assembly 10 comprises the jib outer boom 14, the jib arm 16, and the sliding lock mechanism 18, as illustrated in FIG. 10. In these embodiments, the jib arm 16 extends and retracts out of the outer boom 14. The sliding lock mechanism 18 interfaces with, and pivots relative to, the outer boom 14 and the jib arm 16.

In still further embodiments, the jib assembly 10 is secured to the base 4 of the aerial device 2. In these embodiments, the boom assembly 6 is distinct from the jib arm 16, such that the boom assembly 6 and jib arm 16 each extend from a different location on the base 4. The sliding lock mechanism 18 interfaces between the base 4 and the jib arm 16.

Figure 3:
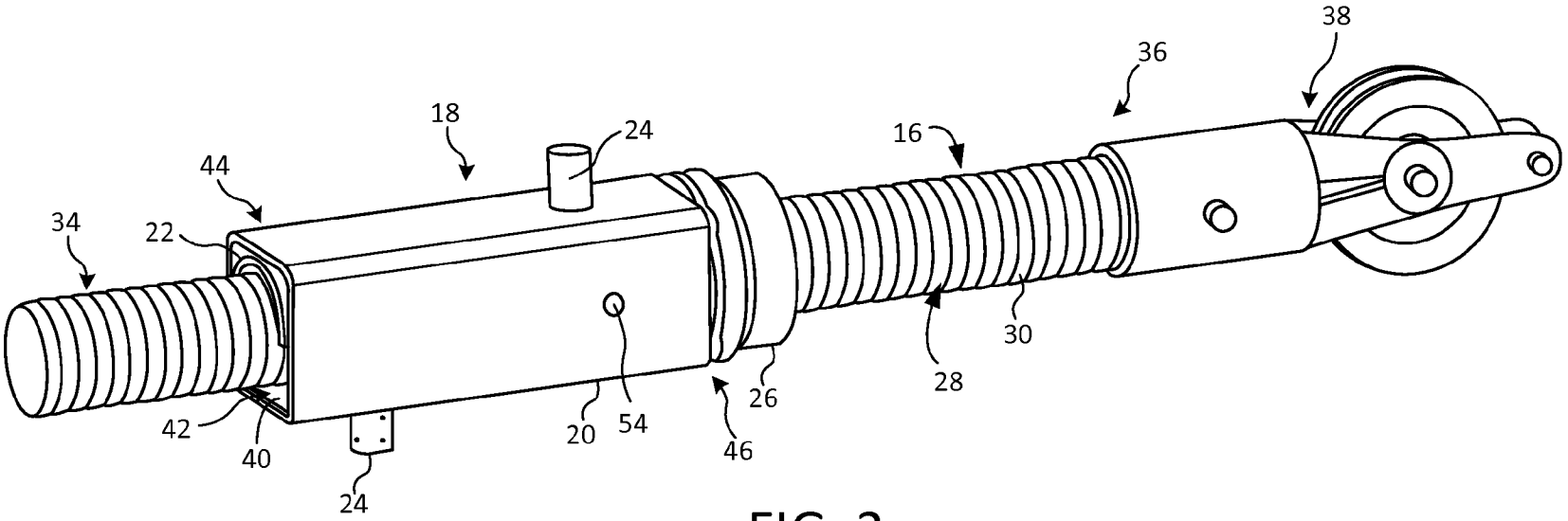
FIG. 3 is a perspective view of the portion of the exemplary jib assembly of FIG. 2, with the jib mounting assembly removed to more clearly show a sliding lock mechanism.

Turning to FIG. 3, the sliding lock mechanism 18 will now be discussed. The sliding lock mechanism 18 may be quickly shifted between at least a first position and a second position. The sliding lock mechanism 18 according to one embodiment comprises a sheath 20, two gripping components 22 (only one is visible in FIG. 3), and two biasing elements 24. Some embodiments of the invention additionally comprise a collar 26 for providing a secondary locking mechanism. Other combinations of these features are within the scope of the invention. Each of these features is discussed in detail below.

The sliding lock mechanism 18 is coupled to the jib arm 16 and in embodiments, surrounds the jib arm 16. The jib arm 16 is an elongated member, shaft, boom, rod, or pole that has a length and presents an outer surface 28, a proximal end 34, and a distal end 36. The jib arm 16 may be formed of a composite material, steel, aluminum, titanium, or PVC. The jib arm 16 may be solid or hollow. According to one embodiment, the outer surface 28 of the jib arm 16 is textured to either mechanically or frictionally interlock with the gripping components 22. As illustrated in FIG. 3, the outer surface 28 includes a plurality of ribs 30 aligned along the length of the jib arm 16 and providing the textured outer surface 28 for securely interlocking with the gripping components 22. In other embodiments, the textured outer surface 28 may include a gradual spiral configuration (not illustrated), a plurality of intermittently-separated protrusions or bulbous bodies extending from the outer surface 28 (not illustrated), or the like. Still further embodiments could utilize a plurality of recesses (not illustrated) on the surface of the jib arm 16. The protrusions, recesses, or bulbous bodies could be a generally pyramid shape, a generally cone shape, or other shape.

Figure 8:
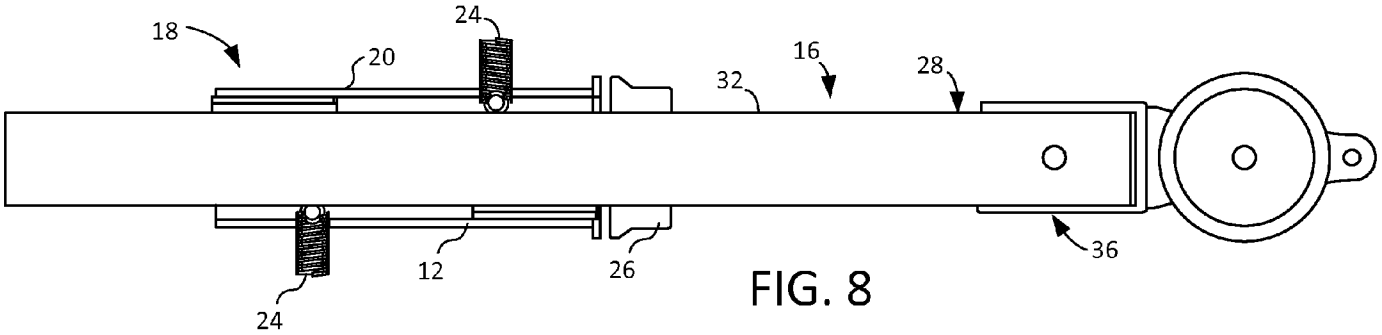
FIG. 8 is a cross-sectional view, along the length of the jib arm, of another exemplary embodiment of a jib assembly, showing the jib assembly in the first position.
Figure 9:
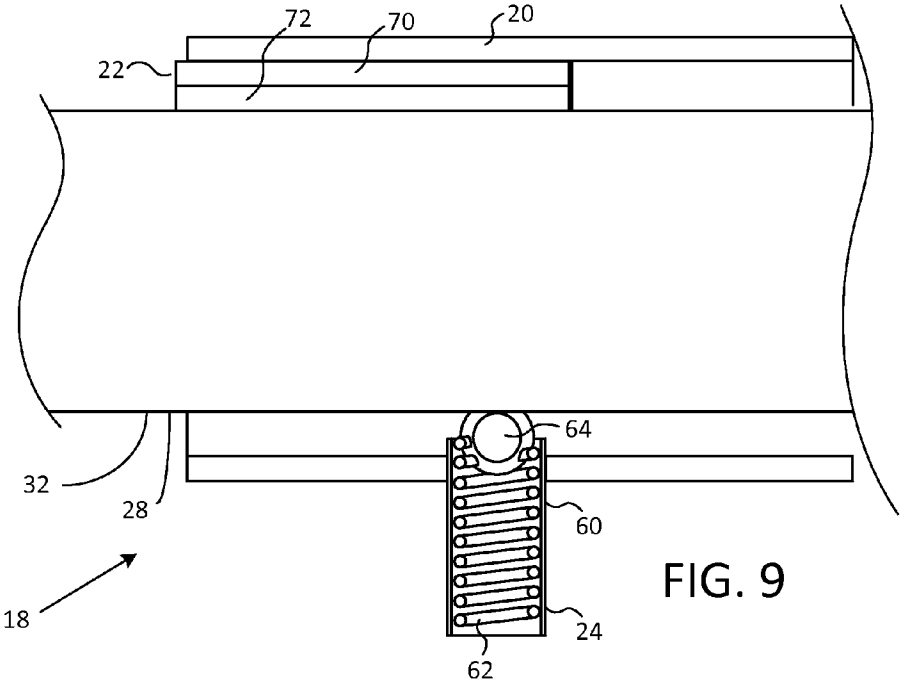
FIG. 9 is a cross-sectional view, along the length of the jib arm, of the exemplary jib assembly in FIG. 8, providing a more detailed illustration of the interaction between the gripping component, a biasing element, and the jib arm.
Figure 12:
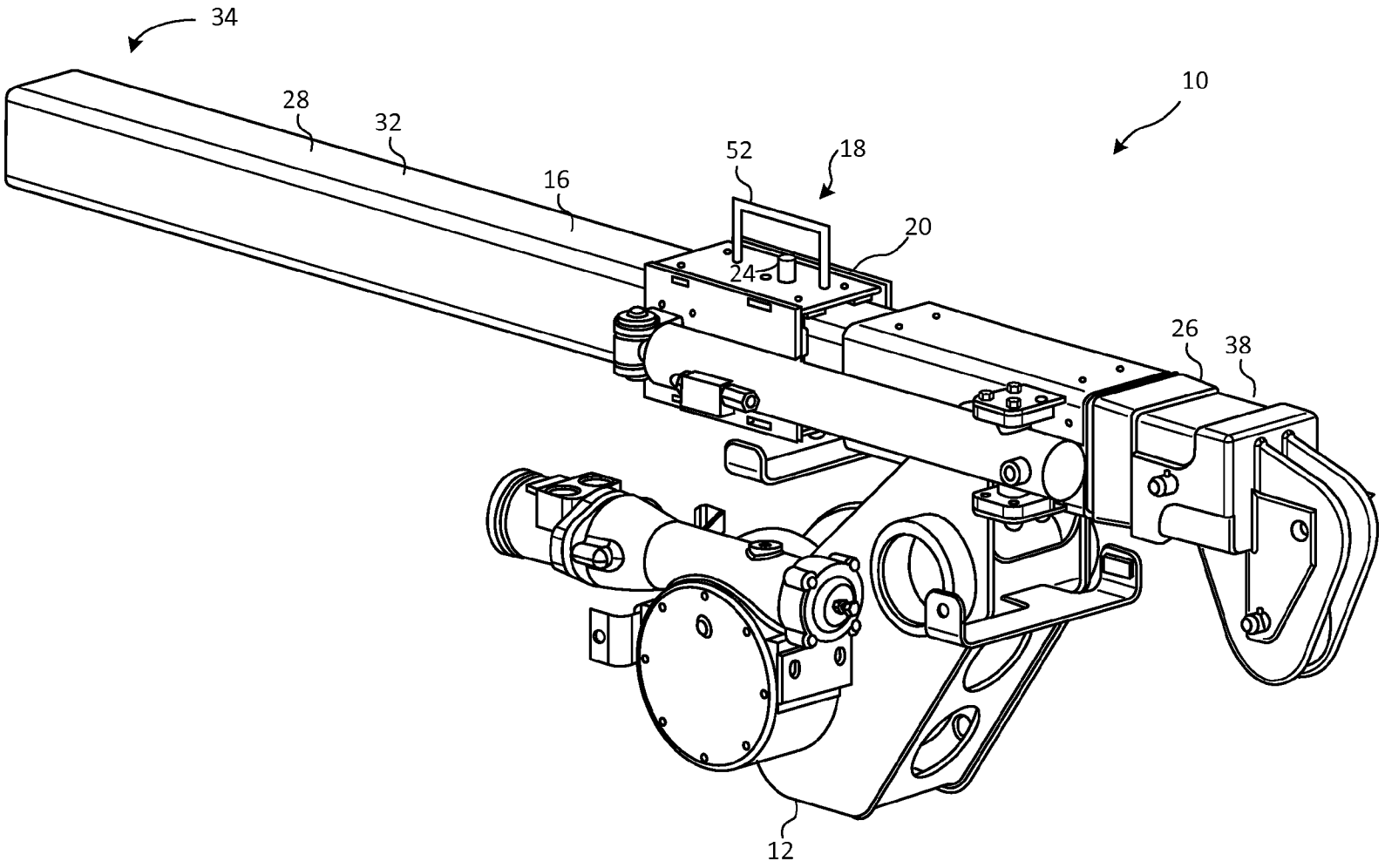
FIG. 12 is a perspective view of yet a further embodiment of the invention in which the jib has a substantially square cross-sectional shape and is hydraulically powered.

In other embodiments of the invention, the jib arm 16 has a substantially flat, even surface 32 (see, FIGS. 8-9 and 12). These embodiments are possible if the gripping components 22 can achieve a sufficient interlock without the ribbed surface 30 or other textured outer surface on the jib arm 16. In still other embodiments of the invention, a first portion (not illustrated) of the outer surface 28 of the jib arm 16 is textured, and a second portion of the outer surface 28 of the jib arm 16 is not textured (not illustrated).

Figure 2:
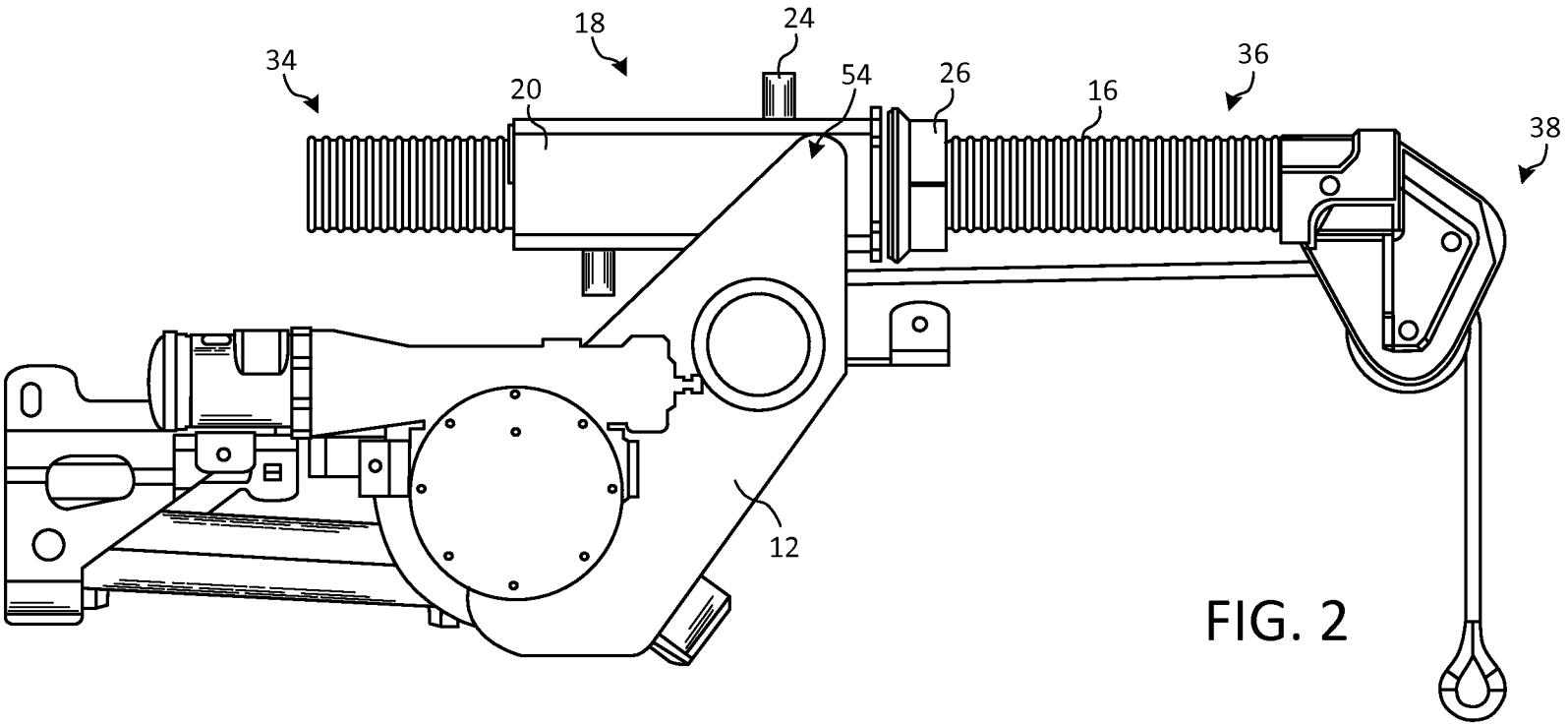
FIG. 2 is a fragmentary perspective view of the exemplary jib assembly of FIG. 1 and illustrating the jib arm mounted to a jib mounting assembly.

Numerous tasks can be performed from the jib arm distal end 36 by the use of a tool 38. In embodiments, the tool 38 is a pulley, as illustrated in the figures, from which the jib arm distal end 36 can support a load (not illustrated). The pulley is also known as a sheave and sheave head. The sheave is a wheel over which a rope moves. The sheave head is a housing to protect the wheel and the rope, as illustrated in FIG. 2. In alternative embodiments, the tool 38 at the jib arm distal end 36 is a hook, a pole guide, a drill bit, a cable, a video camera, a microphone, or a photography camera (not illustrated). The tool 38 at the jib arm distal end 36 could also be a utility platform (not illustrated) for supporting the operator or other person, such as a utility worker or videographer. The jib arm distal end 36 could also support a load by other means. The supported tool 38 need not be at the jib arm distal end 36, but could instead be anywhere along the length of the jib arm 16 as desired by the operator. As used in this application, the term "load" can mean an object to be moved or rotated, an object to be lifted, an object to be installed, or an item of equipment, such as those listed above.

In one embodiment, the jib arm 16 has markings (not illustrated) along at least a portion of the jib arm length. In one embodiment, these markings indicate the distance the jib arm distal end 36 is extended beyond the sheath 20, the collar 26, or other starting position. The markings may represent actual relative lengths (in units of measures such as inches or meters) and be spaced accordingly. Alternatively or in addition, the markings may represent various predetermined positions, such as "stored," "general use," and "maximum extension." Alternatively or in addition, the markings may represent a maximum weight of a load that can be safely lifted by the jib arm 16 when it is extended to the indicated position. The sheath 20 or the collar 26 may additionally have markings for aligning or interpreting the markings on the jib arm 16. In another embodiment, the sheath 20 may have a small viewport or notch (not illustrated) through which the operator can view the markings on the jib arm 16.

Figure 4:
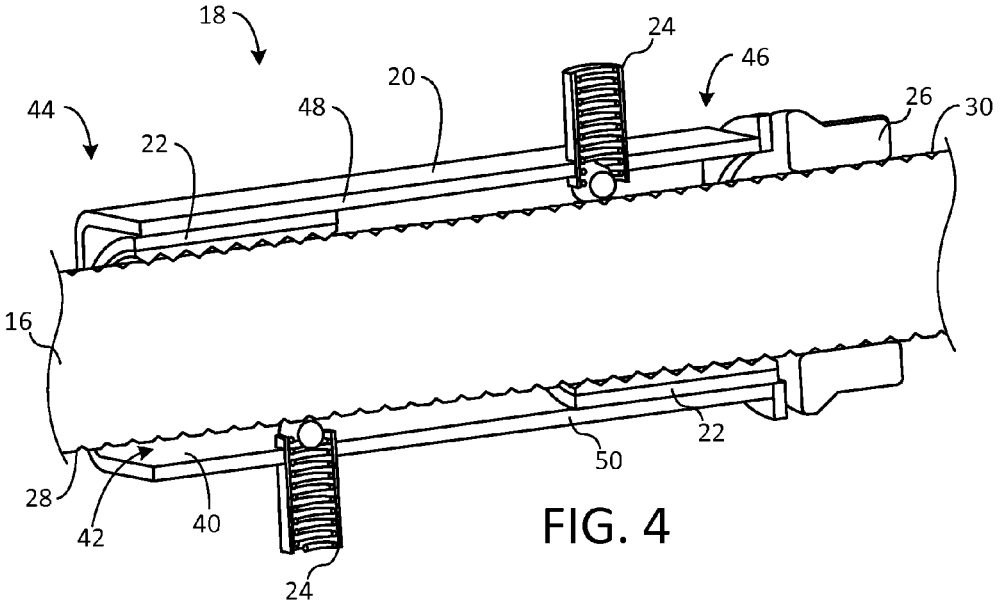
FIG. 4 is a perspective vertical cross-sectional view of the jib assembly along the length of the jib arm and showing a sheath of the jib assembly in a first position.
Figure 5:
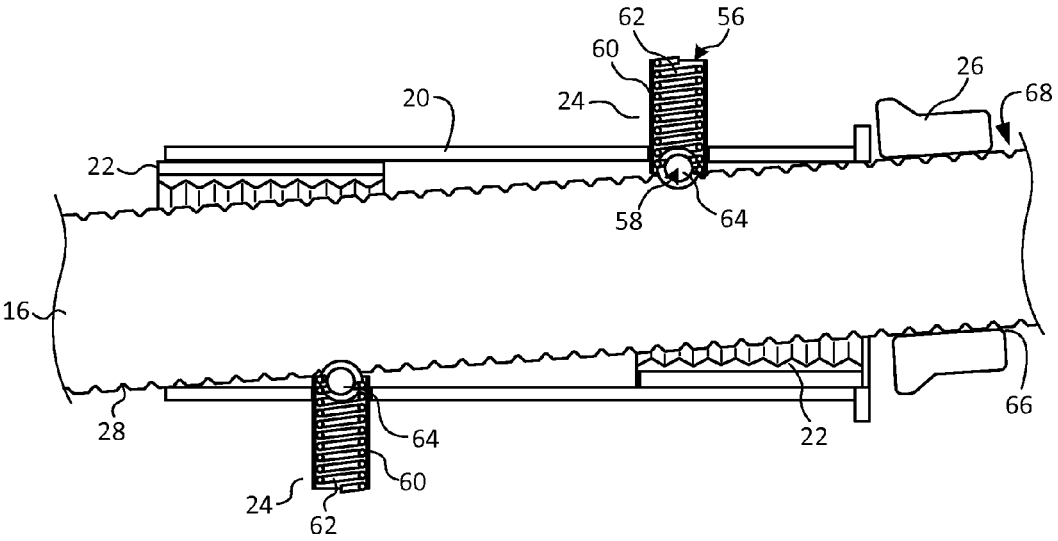
FIG. 5 is a vertical cross-sectional view of the jib assembly along the length of the jib arm and showing the sheath in a second position.

The internal structure and operation of one embodiment of the sliding lock mechanism 18 is illustrated in FIGS. 4-5. The sliding lock mechanism 18, as illustrated in FIG. 4, is in the first position. In this first position, the jib arm 16 can be either bearing a load or not bearing a load. While in the first position, the gripping components 22 prevent the jib arm 16 from extending or retracting by locking into the ribbed surface 30 on the outer surface 28 of the jib arm 16. This allows the operator to safely utilize the jib assembly 10 without the jib arm 16 extending or retracting unexpectedly. The sliding lock mechanism 18, as illustrated in FIG. 5, is in the second position. In this second position, the jib arm 16 can be either bearing a load or not bearing a load. While in the second position, the gripping components 22 are not in contact with the ribbed surface 30 of the outer surface 28 so as to allow extending and retracting.

The "first position" and "second position" of the sheath 20 refer to an orientation or position of the sheath 20 relative to the jib arm 16. In one embodiment, the sheath 20 is in the first position and locked when it is substantially parallel to the jib arm 16. The sheath 20 is in the second position and unlocked when the sheath 20 is not substantially parallel to the jib arm 16. In other embodiments, the sliding lock mechanism 18 could be locked while in a non-parallel configuration and unlocked when in a substantially parallel configuration. In other embodiments, the sliding lock mechanism 18 is in a locked position at one angle away from parallel and unlocked at a different angle away from parallel. In further embodiments, the sheath 20 does not pivot, but instead the gripping components 22 pivot or extend within the sheath 20. In still further embodiments, the sliding lock mechanism 18 is locked by rotating the sheath 20 around the jib arm 16. As used herein, the "first position" indicates the locked position, and the "second position" indicates the unlocked position.

Figure 6:
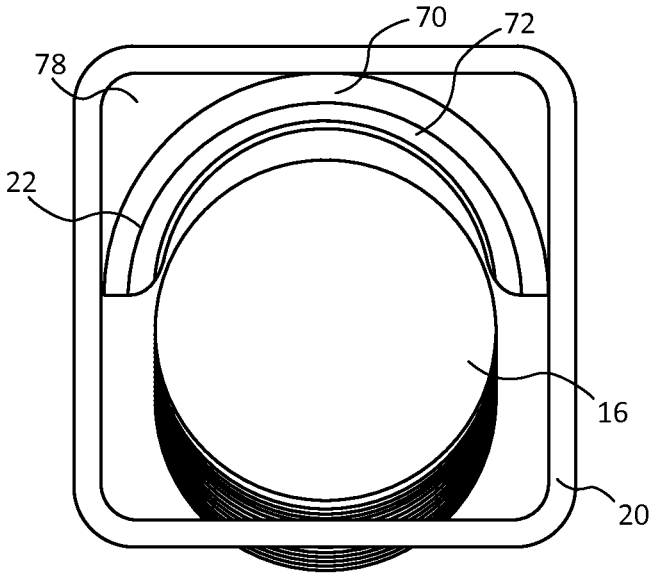
FIG. 6 is a vertical cross-sectional view of the jib assembly along the width of the jib arm, specifically illustrating how the jib arm, gripping components, and sheath are operationally assembled.

The sheath 20 of the sliding lock mechanism 18 presents an interior 40 that defines a void 42. The sheath 20 also presents a sheath proximal end 44 and a sheath distal end 46, as illustrated in FIGS. 3-4. The sheath distal end 46 is oriented in generally the same direction as the jib arm distal end 36. The jib arm 16 is disposed within the void 42 of the sheath 20. As best shown in FIG. 6, in one embodiment of the invention, both the sheath 20 and the void 42 have a substantially square or rectangular vertical cross-sectional shape across the width. In another embodiment, the sheath 20 and the void 42 have a substantially circular or elliptical vertical cross-sectional shape across the width. In other embodiments, the sheath 20 and the void 42 have vertical cross-sectional shapes across the width that are not substantially similar.

The gripping components 22 are disposed on the interior 40 of the sheath 20, such that they occupy a portion of the void 42. In one embodiment, illustrated in FIGS. 4-5, the gripping component 22 that is on the sheath proximal end 44 is located on a top segment 48 of the sheath 20 facing toward a bottom segment 50 of the sheath 20. In this embodiment the gripping component 22 that is on the sheath distal end 46 is located on the bottom segment 50 of the sheath 20 facing toward the top segment 48. This configuration assists in supporting a load in the downward direction from the jib arm distal end 36. As used herein, the downward direction and the bottom segment 50 of the sheath 20 refer to the direction of the force that a load would place on the jib assembly 10, typically toward the Earth. The bottom segment 50 of the sheath 20 is oriented in the downward direction. The upward direction and the top segment 48 of the sheath 20 refer to the direction opposite the downward direction.

When the sliding lock mechanism 18 is in the second position, as illustrated in FIG. 5, the jib arm 16 can be extended or retracted as desired by the operator. In the second position, the gripping components 22 are not in contact with the jib arm 16. This allows for the jib arm 16 to freely extend and retract. In embodiments, the jib arm 16 is under no load or a relatively light load when the sliding lock mechanism 18 is in the second position, due to the jib arm 16 being movable relative to the sheath 20.

In one embodiment, the sheath 20 has a handle 52 to facilitate the gripping thereof by the operator, as illustrated in FIG. 12. The handle 52 is integral to the sheath, or, in embodiments, is separate from but coupled to the sheath. In embodiments of the invention, the handle 52 may be formed of a material with a high coefficient of friction, such as a polymer. In other embodiments the handle 52 is formed of a metal. In yet other embodiments, the handle 52 comprises an extended bar or knob (not illustrated) to facilitate the gripping thereof by the operator. In still another embodiment, the sheath 20 does not include a handle for gripping by the operator, such that the operator simply grips the sheath 20, as shown in FIGS. 3 and 8. In still a further embodiment, the sheath 20 is adapted to pivot between the first position and the second position by a mechanical, hydraulic, pneumatic, or electrical actuation other than direct force by the operator (not illustrated).

In one embodiment, the sheath 20 is pivotably coupled to the base 12, as illustrated in FIGS. 2 and 12. In another embodiment, the sheath 20 is pivotably coupled to an outer boom 14 as illustrated in FIGS. 10-11, that houses the jib arm 16 when it is not extended. In yet a further embodiment, the sheath 20 is pivotably attached to the jib mounting assembly 12 or the outer boom 14. In one embodiment, the sheath 20 is attached to the outer boom 14 via a pivoting segment 54 that would allow the sheath 20 to pivot into and out of the first position. In embodiments of the invention, the pivoting segment 54 comprises two pins (not illustrated). In another embodiment of the invention, the pivoting segment 54 comprises a protrusion and a recess (not illustrated). In another embodiment, the sheath 20 is pivotably coupled to the jib mounting assembly 12 or the outer boom 14 via a rubber gasket (not illustrated) that would allow the sheath 20 to rotate away from parallel with the jib arm 16.

In embodiments of the invention, the extension and retraction of the jib arm 16 relative to the sheath 20 is facilitated by the use of two biasing elements 24. In one embodiment, the biasing elements 24 are located opposite the gripping component 22, as best shown in FIGS. 4 and 5. In another embodiment, the biasing elements 24 are located on the same side as the gripping component 22 and approximately adjacent thereto on either the sheath distal end 46 or the sheath proximal end 44.

In embodiments of the invention, the biasing element 24 of one embodiment comprises an actuator 56, a friction reducing element 58, and a biasing element housing 60, as shown in FIG. 5. The actuator 56 maintains the friction reducing element 58 in contact with the jib arm 16 regardless of whether the sliding lock mechanism 18 is in the first position, the second position, or any other possible position. The friction reducing element 58 provides support for the jib arm 16 while it is extending or retracting. The actuator 56 is housed inside a biasing element housing 60. The biasing element housing 60 protects the actuator 56 and provides a backstop against which the actuator 56 remains under tension.

In embodiments of the invention, the actuator 56 comprises a spring 62. In other embodiments of the invention, the actuator 56 comprises a motor (not illustrated) that operates by a source of energy, such as electrical current, rotary mechanical motion, hydraulic fluid pressure, or pneumatic pressure.

In embodiments of the invention, the friction reducing element 58 comprises a roller 64 that is rotatably coupled to the actuator 56, as illustrated in FIGS. 5 and 9. In these embodiments, the roller 64 can roll along the length of the jib arm 16 as the jib arm 16 extends and retracts out of the sheath 20. In another embodiment, the friction reducing element 58 comprises a ball or hemi-spherical end (not illustrated). In one embodiment, the friction reducing element 58 is made out of a material with a low coefficient of friction.

In other embodiments, at least one additional biasing element 24 may be utilized to ensure the smooth and efficient operation of the jib arm 16. In embodiments of the invention, at least one of these additional biasing elements 24 is positioned along the sheath 20 further toward the sheath proximal end 44 or the sheath distal end 46. In another embodiment, at least one of these additional biasing elements 24 is positioned at an angle away from vertical, such that the biasing elements 24 provide lateral support to the jib arm 16.

In one embodiment, the outer surface 28 of the jib arm 16 comprises a ribbed surface 30 and a flat surface 32, wherein the friction reducing element 58 is adapted to move longitudinally along the flat surface 32. This will allow for a smoother operation of the friction reducing element 58 as it moves along the jib arm 16. In another embodiment, the friction reducing element 58 moves along the plurality of ribs 30 on the outer surface 28 of the jib arm 16. In still another embodiment, the jib arm 16 has no ribbed surface at all but instead has a flat surface 32, as illustrated in FIGS. 8-10.

In one embodiment, the jib arm 16 may include a complementary alignment element (not illustrated) that extends along a portion or the entire length of the jib arm 16. The complementary alignment element may be a ridge, a guide, a groove, a recess, a notch, or other complementary shape. The complementary alignment element keeps the jib arm 16 aligned with an alignment element on the sheath 20 to prevent the jib arm 16 from inadvertently rotating about its longitudinal axis. In another embodiment, there may be more than one complementary alignment element.

Turning now to FIG. 3, in embodiments of the invention, the collar 26 is substantially ring-shaped and presents a collar inner surface 66 that surrounds the jib arm 16, such that the jib arm 16 extends through the collar 26. The collar 26 remains generally parallel to the jib arm 16, regardless of whether the jib arm 16 is in the first position, the second position, or other intermediate position. In embodiments, the collar 26 is adjacent to the sheath 20, as illustrated in FIGS. 3-5, and the collar inner surface 66 is in contact with a portion of the jib arm outer surface 28. In other embodiments, the collar inner surface 66 is adapted to selectively come into contact with the jib arm outer surface 28.

In embodiments of the invention, the collar inner surface 66 (see FIG. 5) is made of a material with a low coefficient of friction that allows for the smooth transition of the jib arm 16 across the inner surface 66 of the collar 26. In another embodiment, the inner surface of the collar 26 is made of a material having a high coefficient of friction, such that the collar 26 will assist the gripping components 22 in securing the jib arm 16 when in the first position. In other embodiments of the invention, the collar 26 comprises both an inner surface with a high coefficient of friction and an inner surface with a low coefficient of friction, which the operator can interchange between.

In one embodiment, the collar 26 is attached to the sheath 20, such that the collar 26 may rotate to a non-parallel position relative to the sheath 20. In this embodiment, the collar 26 prevents the jib arm 16 from directly contacting the sheath 20, as this will add additional friction to the moving jib arm 16 and cause potential damage to both components. Another embodiment of the invention does not restrict the movement of the collar 26, such as in the case of a jib arm 16 that does not have a ribbed surface or there is a non-ribbed section through with the friction-reducing elements 58 move.

In another embodiment, the collar 26 is not attached to the sheath 20, as shown in FIGS. 4-5 and 8. In this embodiment, the collar 26 prevents the jib arm 16 from retracting beyond a predetermined point when the sliding lock mechanism 18 is in a second configuration, such that the collar 26 serves as a lateral stop along the length of the jib arm 16. The collar 26 frictionally engages the jib arm 16 near the distal end 46 of the sheath 20 and thereby prevents the jib arm 16 from retracting any further. The operator may apply a force to the collar 26 to disengage the collar 26 from the jib arm 16.

FIG. 6 illustrates one embodiment of how the jib arm 16, gripping components 22, biasing element 24, and sheath 20 are operationally coupled together. The length of the jib arm 16 is positioned through the sheath 20. There is sufficient vertical space between the sheath 20 and the jib arm 16 to allow the sheath 20 to be pivoted in such a position to unlock the sliding lock mechanism 18. There is sufficient horizontal space between the sheath 20 and the jib arm 16 to allow room for the gripping component 22 and to allow the jib arm 16 to extend and retract.

FIG. 6 also illustrates the components and structure of the gripping components 22 in one embodiment. In embodiments of the invention, the gripping components 22 comprise a mounting segment 70 and a gripping segment 72. The mounting segment 70 is securely coupled to the sheath 20. In embodiments of the invention, the mounting segment 70 is securely coupled to the sheath 20 via a plurality of fasteners (not illustrated), such as bolts or rivets. In other embodiments of the invention, the mounting segment 70 is securely coupled to the sheath 20 via a high-strength adhesive or via welding. In another embodiment, the sheath 20 and the mounting segment 70 are monolithic.

Figure 7:
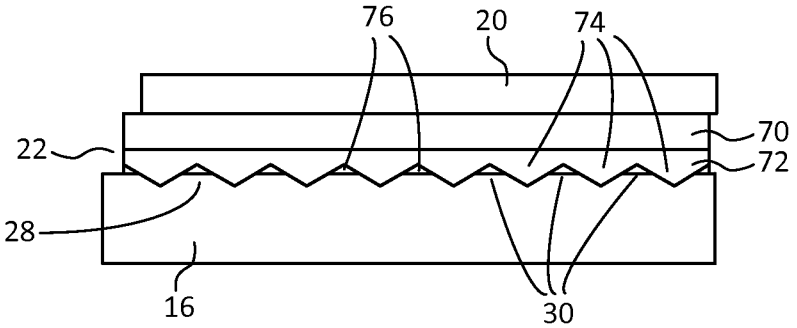
FIG. 7 is a cross-sectional view, along the length of the jib arm, of the exemplary jib assembly in FIG. 4, providing a more detailed illustration of the interaction between the gripping component and the jib arm.

Referring to FIG. 7, in embodiments of the invention, the gripping segment 72 of the gripping component 22 has an appreciable thickness. In some embodiments of the invention, the gripping segment 72 presents a plurality of gripping protrusions 74 that define a plurality of gripping recesses 76, as best shown in FIG. 7. In some embodiments, the gripping protrusions 74 and gripping recesses 76 are substantially complementary to the plurality of ribs 30 on the outer surface 28 of the jib arm 16. These embodiments may be advantageous for three reasons. First, the complementary shape increases the surface area of contact between the gripping segment 72 and the jib arm 16. Second, the gripping protrusions 74 provide lateral support to prevent the jib arm from slipping to extend and retract. Third, a structural failure in one portion of the gripping segment would not lead to a catastrophic loss of friction. In other embodiments of the invention, the gripping segment 72 is substantially flat, as shown in FIGS. 8-9.

The gripping components 22 present a surface area that is in contact with the jib arm 16 when the sheath 20 is in the first position. The surface area of the gripping components 22 provides a sufficiently large area that frictionally engages with the jib arm 16 to stabilize the jib arm 16 within the sheath 22. The surface area of the gripping components 22 is defined by a length, which runs longitudinally in the same direction as the jib arm 16, and a width, which runs counter to the length. As illustrated in FIG. 6, the width may be curved to generally complement the dimensions of the jib arm 16. Even in this embodiment, the surface area is still calculated by the linear distance traversed along the surface of the gripping component 22. The surface area may be increased by increasing the length and/or width of the gripping components 22 up to a certain extent, while leaving room in the sliding lock mechanism 18 for the sheath 20 to move into the second position.

In embodiments of the invention, the gripping segment 72 of the gripping component 22 is formed of a polymer, such as rubber, such that the gripping segment 72 has a high coefficient of friction, yet minimizes damage to the jib arm 16 and itself. In one embodiment of the invention, the gripping segment 72 is securely coupled to the mounting segment 70 via at least one mechanical fastener, such as a bolt or rivet (not illustrated). In another embodiment of the invention, the gripping segment 72 is securely coupled to the mounting segment 70 via a high-strength adhesive. In embodiments of the invention, the gripping segment 72 is replaceable should it become worn or damaged. The gripping segment 72 may be formed of an applied gripping material covering a metal substrate. In still another embodiment, the gripping component 22 is a single, monolithic structure that is secured directly to the sheath 20.

As illustrated in FIG. 6, in embodiments of the invention, the sliding lock mechanism 18 presents a gap 78 between the gripping component 22 and the interior 40 of sheath 20. Depending on the relative sizes and shapes of the sheath 20 and jib arm 16, as discussed above, this gap 78 may be a different size, a different shape, or may be eliminated. A portion of the gap 78 may also be taken up by mechanical fasteners (not illustrated) that secure the gripping component 22 to the sheath 20. It should be noted that in FIG. 6, the sheath 20 is illustrated as being generally square at vertical cross-section about the width, and the jib arm 16 that is generally round in shape at vertical cross-section about the width. In another embodiment, both the sheath 20 and jib arm 16 are generally square at cross-section, as illustrated in FIG. 12. Other embodiments could utilize any combination of shapes in making up the sheath 20 and the jib arm 16.

FIG. 7 illustrates the interaction between the sheath 20, the gripping components 22, and the jib arm 16. In one embodiment the gripping segment 72 has a ribbed surface. This ribbed surface complements the ribbed surface 30 of the outer surface 28 on the jib arm 16. The two respective surfaces need not precisely complement each other. In one embodiment, as illustrated in FIG. 7, the jib arm 16 has a outer surface 30 wherein the ribs do not have a pointed tip. This facilitates the friction reducing element 58 moving smoothly across the outer surface 30 of the jib arm 16. However, in other embodiments such as where this friction reducing element 58 moves along a groove or notch, the jib arm 16 may have a outer surface 30 wherein the ribs have a pointed tip.

In one embodiment of the invention, the sliding lock mechanism 18 is utilized to allow for the extension and retraction of the jib arm 16. In another embodiment of the invention, not illustrated, the sliding lock mechanism 18 could also be utilized for moving a load along the jib arm 16, instead of for extending and retracting the jib arm 16 of the jib assembly 10. In another embodiment of the invention, not illustrated, the sliding lock mechanism is utilized with a stationary member that is supported on both ends, instead of a jib assembly 10. When the sliding lock mechanism is unlocked, the load is moved along the member to a desire location. Then, the operator simply lets go when the load reaches the desired location, and the sliding lock mechanism 18 automatically locks itself into that position.

In still another embodiment of the invention, the sliding lock mechanism is adapted to disassemble in such a way that it can be added to and removed from a jib assembly 10 or stationary member as needed.

One embodiment of a method of using the sliding lock mechanism 18 will now be discussed. By default, the sliding lock mechanism 18 is in the first position, which is the locked position, such that the gripping components 22 are frictionally engaging the jib arm 16, as shown in FIG. 4. To extend or retract the boom arm 16, the operator grasps the handle 52 or the sheath 20 with his hand and pivots the sheath 20 into the second position, shown in FIG. 5, by overcoming the force exerted by the biasing elements 24. The pivoting of the sheath 20 removes the gripping components 22 from contacting the jib arm 16. The operator then holds the sheath 20 in the second position while the boom arm 16 is extended. The operator or other user manipulates the jib arm 16 to extend the jib arm 16 to a desired length via hydraulic power. The operator then releases the sheath 20 or handle 52. The force generated by the biasing elements 24 on the jib arm 16 returns the sliding lock mechanism 18 to the first position. The sliding lock mechanism is then locked via the gripping components 22 being in contact with the jib arm 16, such that the jib arm 16 is prevented from extending or retracting any further.

Although the invention has been described with reference to the exemplary embodiments illustrated in the attached drawings, it is noted that equivalents may be employed and substitutions made herein without departing from the scope of the invention as recited in the claims. Other methods may be used without departing from the scope of the invention.

Having thus described various embodiments of the invention, what is claimed as new and desired to be protected by Letters Patent includes the following:

1. A jib assembly comprising:

a jib mounting assembly;

an elongated jib arm coupled to the jib mounting assembly and presenting an outer surface, a jib arm proximal end, and a jib arm distal end;

a sliding lock mechanism including— a sheath presenting an inner surface defining a void, a sheath proximal end, and a sheath distal end, wherein at least a portion of the jib arm is disposed in said void and adapted to extend out of the sheath and retract into the sheath; and at least a first gripping component and a second gripping component disposed on said inner surface, wherein said first gripping component and said second gripping component are operable to engage the jib arm to secure the jib arm and prevent the jib arm from extending and retracting relative to the sheath by aligning the sheath in a first position, wherein said first gripping component and said second gripping component are operable to disengage the jib arm to allow at least a portion of the jib arm to extend and retract out of the sheath by rotating the sheath to a second position.

2. The jib assembly of claim 1, wherein at least a portion of the first gripping component and the second gripping component is replaceable and formed of a polymer.

3. The jib assembly of claim 1, wherein the sheath is in said first position when the sheath is substantially parallel with the jib arm, wherein the sheath is in said second position when the sheath is pivoted substantially away from parallel with the jib arm.

4. The jib assembly of claim 1, wherein the sheath presents a handle which is operable by the user to rotate the sheath between the first position in which the sheath is substantially parallel with the jib arm and a second position in which the sheath is pivoted away from substantially parallel with the jib arm.

5. The jib assembly of claim 1, wherein the sheath is pivotably coupled to the jib mounting assembly, wherein the jib mounting assembly is securely coupled to a utility platform of a boom assembly of an aerial device.

6. The jib assembly of claim 1, wherein said first gripping component and said second gripping component are disposed on opposite sides of the inner surface of the sheath and offset from each other.

7. The jib assembly of claim 6, wherein the first gripping component is positioned proximate the distal end of the sheath and on a bottom segment of the sheath, and the second gripping component is positioned proximate a proximal end of the sheath and on a top segment of the sheath.

8. The jib assembly of claim 1, wherein at least a portion of said outer surface of said jib arm further comprises a ribbed surface.

9. The jib assembly of claim 8, wherein at least one of said first gripping component and said second gripping component further comprises a plurality of gripping protrusions that present a plurality of gripping recesses between the gripping protrusions, wherein said ribbed surface of the outer surface of the jib arm is substantially complementary with the plurality of gripping protrusions and the plurality of gripping recesses.

10. The jib assembly of claim 1, further comprising at least one biasing element operable to exert a force on the jib arm through the sheath.

11. The jib assembly of claim 10, wherein the at least one biasing element includes at least a first biasing element and a second biasing element, wherein the first biasing element and second biasing element are disposed on opposite sides of the sheath and offset from each other, such that said force exerted on the jib arm is in a pitching rotation direction.

12. The jib assembly of claim 10, wherein the at least one biasing element comprises:

an actuator, and a friction-reducing element coupled to said actuator, wherein the friction-reducing element is configured to contact said outer surface of the jib arm and reduce friction between the biasing element and the jib arm.

13. The jib assembly of claim 12, wherein the actuator comprises a spring and an biasing element housing, wherein the friction-reducing element comprises a roller.

14. The jib assembly of claim 1, further comprising a collar, presenting a collar inner surface defining a collar void, wherein the jib arm is disposed in the collar void.

15. The jib assembly of claim 14, wherein the collar inner surface is operable to frictionally engage the jib arm thereby preventing the jib arm from extending and retracting when the collar is adjacent to the sheath distal end.

16. The jib assembly of claim 15, wherein the jib arm is adapted to extend or retract with respect to the collar upon applying a force to the collar.

17. The jib assembly of claim 14, wherein said collar is attached to said sheath distal end, such that the collar is operable to remain substantially parallel to the jib arm regardless of the orientation of the sheath.

18. The jib assembly of claim 17, wherein the jib arm is operable to extend or retract with respect to the collar when a user applies a force to the collar.

* * * * *